US005621934A

United States Patent [19]

Olkkonen et al.

[11] Patent Number: 5,621,934

[45] Date of Patent: Apr. 22, 1997

[54] MATTRESS

[75] Inventors: Kari Olkkonen, Tuusula; Simo Paltere, Lohja, both of Finland

[73] Assignee: A. Ahlstrom Corporation, Noormarkku, Finland

[21] Appl. No.: 450,426

[22] Filed: May 25, 1995

Related U.S. Application Data

[63] Continuation-in-part of Ser. No. 9,648, Jan. 27, 1993, Pat. No. 5,586,348, which is a continuation-in-part of Ser. No. 625,940, Dec. 11, 1990, abandoned, which is a continuation-in-part of Ser. No. 209,978, Jun. 22, 1988, Pat. No. 4,999, 867.

[30] Foreign Application Priority Data

Jun. 17, 1994 [FI] Finland ..... 942946

[51] Int. Cl.[6] ..... A47C 27/08

[52] U.S. Cl. ..... 5/710; 5/689; 5/690; 5/706

[58] Field of Search ..... 5/449, 455, 453, 5/441, 456, 689, 690, 706, 710; 411/84, 508, 509, 510, 908

[56] References Cited

U.S. PATENT DOCUMENTS

| | | | |
|---|---|---|---|
| 1,711,255 | 4/1929 | Weinman et al. | 5/455 |
| 2,751,510 | 6/1956 | Griswold . | |
| 3,181,219 | 5/1965 | Deshales | 24/697.1 |
| 3,192,540 | 7/1965 | Swank . | |
| 3,210,820 | 10/1965 | Humiston | 24/697.1 |
| 3,736,027 | 5/1973 | Stafford . | |
| 3,762,404 | 10/1973 | Sakita . | |
| 4,310,936 | 1/1982 | Benjamin . | |
| 4,428,087 | 1/1984 | Horn . | |
| 4,467,484 | 8/1984 | Nagatake et al. . | |
| 4,472,472 | 9/1984 | Schultz | 5/420 |
| 4,637,083 | 1/1987 | Goodwin . | |
| 4,651,369 | 3/1987 | Guldager | 5/455 |
| 4,662,012 | 5/1987 | Torbet . | |
| 4,682,378 | 7/1987 | Savenije . | |
| 4,686,722 | 8/1987 | Swart . | |
| 4,694,520 | 9/1987 | Paul et al. . | |
| 4,698,864 | 10/1987 | Graebe . | |
| 4,797,962 | 1/1989 | Goode . | |
| 4,924,541 | 5/1990 | Inagaki | 5/449 |
| 4,999,867 | 3/1991 | Toivio et al. . | |

FOREIGN PATENT DOCUMENTS

| | | | |
|---|---|---|---|
| 3535374 | 4/1987 | Germany . | |
| 372880 | 11/1971 | Sweden . | |
| 959103 | 5/1964 | United Kingdom . | |
| 1442994 | 7/1976 | United Kingdom . | |
| 1498661 | 1/1978 | United Kingdom | 5/455 |
| 1545806 | 5/1979 | United Kingdom . | |
| 2141333 | 12/1984 | United Kingdom | 5/455 |
| 92/07541 | 5/1992 | WIPO . | |

*Primary Examiner*—Steven N. Meyers
*Assistant Examiner*—Tuyet-Phuong Pham
*Attorney, Agent, or Firm*—Merchant, Gould, Smith, Edell, Welter & Schmidt, P.A.

[57] ABSTRACT

The invention relates to a mattress, particularly an air mattress. It comprises a bottom element (1) and a number of elongated, bag-like mattress elements (2), which may be inflated with gas such as air and are adjacently attached in the bottom element (1) of the mattress, transversally to the lengthwise direction (D—D) of the mattress and in such a fashion that they form, when inflated with gas, loop-like members, resembling an overturned U-shape or the like in cross-section, and extending outwards from the bottom element. The mattress may also comprise a number of second elongated, air-inflatable or similar resilient bag-like mattress elements. In that case, the first mattress element is arranged to encompass, at least partly, the second mattress element. According to the invention, the mattress elements (2) are secured to the bottom element of the mattress by means of fastening members, which may be mechanically locked to each other so that each mattress element (2) may be detached from the bottom part (1) and replaced.

13 Claims, 6 Drawing Sheets

MATTRESS

This application is a continuation-in-part application of Ser. No. 08/009,648 filed on Jan. 27, 1993, U.S. Pat. No. 5,586,348, which in turn is a continuation-in-part application of Ser. No. 07/625,940, filed on Dec. 11, 1990, abandoned, which in turn is a continuation-in-part application of Ser. No. 07/209,978, filed on Jun. 22, 1988, U.S. Pat. No. 4,999,867.

The present invention relates to a mattress, particularly an air mattress, comprising a number of adjacent, elongated bag-like elements which may be filled with gas such as air, or with some other fluid medium. The elements have been arranged in the bottom part of the mattress, transversally with respect to the longitudinal axis of the mattress and/or the bed.

In the prior art there is known, from the British patent publication 2,141,333, a bed composed of separate, adjacent sac-like elements. The elements have been arranged inside the bed frame structure, transversally with respect to the longitudinal direction of the bed. Further, the elements have been divided into five groups, and each of these groups has been connected by means of separate conduits to an air supply device and an outlet channel. The elements have been attached to the bed frame structures at the sides, so that the inlet and outlet air channels lead to the elements.

A drawback of the bed structure described is that the mattress is built as an integrated part of the bed, and cannot be used as a separate mattress in other beds. Another drawback is, that if one of the elements is broken, the pressure in a whole group of elements decreases, and in the worst case the whole bed becomes unusable and the patient must immediately be transferred to another bed. It is also pointed out that the bed and mattress combination introduced in the British patent publication is designed particularly for hospital environment, and that it is complicated in structure and expensive to manufacture, and consequently by no means suitable to be used as an ordinary mattress for example at home.

The object of the present invention is to provide an improved mattress, particularly an air mattress, by means of which for example the drawbacks of the mattresses described above can be avoided.

The mattress of the invention, particularly an air mattress, comprises an essentially rectangular, bendable, plate-like bottom element; and a number of elongated bag-like mattress elements, which may be inflated with gas such as air, or with some other fluid medium, and have been attached adjacently in the bottom element, transversally with respect to the lengthwise direction of the mattress, so that they form, when inflated with gas or the like, loop-like elements extending outwards from the bottom element and in cross-section resemble an overturned letter U or a similar shape. According to the invention, each mattress element has been secured to the bottom element of the mattress by means of interlockable fastening members; each mattress element may thus be detached from the bottom element and replaced by a new one.

A preferred embodiment of the mattress comprises a number of second elongated bag-like mattress elements, which may be inflated with gas or some other fluid medium, or are made of some solid, resilient material or filled with such material; so that a first mattress element has been arranged to encompass, at least partly, each second mattress element.

The matching fastening members provided in the mattress element and in the bottom element may be effected in many different ways. It is advantageous that the fastening members may be easily locked and unlocked; for instance they may be means which are connected by pressing them together, and respectively disconnected by pulling them apart. On the other hand, in addition to easy locking and unlocking functions, another requirement is that the mattress elements remain reliably attached in the bottom element and do not come off by themselves. Thus it is advantageous that the mattress elements are connected with fastening members to the bottom element either at several successive spots, or continuously, in which case the gripping surface is large.

In an embodiment of the mattress, the fastening members are formed of matching male and female fastening members. Thus, the fastening members are easily locked together and respectively unlocked.

The longitudinal sides of the mattress elements and the bottom element of the mattress have preferably been provided with openings for attaching the fastening members to each other. Adjacent mattress elements may then be placed overlapping, i.e. two mattress elements are secured to the bottom element by one pair of fastening members by placing the longitudinal side of each mattress element and the bottom element between the fastening members which are then interlocked. The adjacent mattress elements may also be secured each separately whereby one of the fastening members may be provided in the mattress element and the other in the bottom element of the mattress.

In an embodiment of the mattress, the male fastening member is formed of an elongated thin piece provided with one or more brackets and the female fastening member is formed of an elongated counter part provided with holes for locking the brackets thereto. The fastening members are preferably elongated plastics batten strips made for example of polycarbonate. They may be for example 12 cm (length)× 1.2 cm (width)×0.8 cm (height) in size whereby three of them are needed for securing one long side of a mattress element to the bottom element. The fastening members may also be batten strips substantially as long as the mattress element. For example, if it is desirable to effect the male fastening members as an integrated part of the mattress bottom element the male fastening members may be for example pins or a studs provided in the bottom element instead of the openings, and the pins or studs are locked to the openings in the female fastening members.

In an embodiment of the mattress, the fastening members are formed of press buttons, particularly of its opposite pieces to be connected to each other. The flange of the press button must be adequately large, preferably having a diameter of 30 mm and an adequate number of the press buttons must be provided at appropriate spacing so as to ensure safe securing of the mattress elements. The counterparts of the press button could also be provided directly in the mattress element and/or the bottom element whereby the fastening openings in the bottom element mentioned above could be dispensed with.

As for the advantages of the mattress of the invention, it is generally maintained that such persons or patients who have long been or permanently are confined to bed and cannot themselves turn or move their limbs, do not get bedsores on the mattress of the invention, unlike when the patient is lying on an ordinary bedding. The pressures in the mattress elements can be easily adjusted, taking into account both the patient's weight and the body parts to be supported, to be such that the skin surface pressure in each part of the body is as low as advantageous.

A particular advantage of the mattress of the invention is, that its elongated bag-like mattress elements are replaceable by new corresponding elements, when for one reason or another the gas or other fluid pumped therein flows out. Moreover, a leaking mattress element is easily replaced even when a patient is lying on the bed, because the fastening members are simple and are easily unlocked and locked, respectively. A mattress element may be deflated for instance when a hypodermic syringe used for giving an injection to a patient accidentally punctures a mattress element. It is also pointed out that even the breaking of only one element may raise the patient's skin surface pressure in the area of this element, and thus the danger of bedsores increases.

When an element is broken the whole mattress would have to be taken to be maintained if individual mattress elements were not detachable. This is very inconvenient particularly if the mattress has been used by a patient carrying a contagious disease. According to the invention an individual mattress element may be replaced by a new one on the spot and people outside the unit do not come in contact with the mattress. This greatly reduces the risk of spreading contagious diseases.

Yet another advantage of the present invention is that the mattress is simple in structure and economical in production costs. The reason for this is that the fastening members used are simple pieces, which are easily attached to each other.

Yet another advantage of the invention is that the fastening members may be effected in many different ways, depending on the type of use and the preset requirements.

In the following the invention is explained in detail by way of example with reference to the appended drawings, in which;

FIG. 1 illustrates a schematic top-view of a mattress of the present invention;

FIG. 2*a* illustrates a part of the mattress of FIG. 1, seen from the side;

FIG. 2*b* is an enlarged cross-sectional illustration of the fastening members of the mattress of FIG. 1, detached from each other;

FIG. 9 is similar to FIG. 6, only the fastening member is integrally formed with the bottom element.

Figure 1:
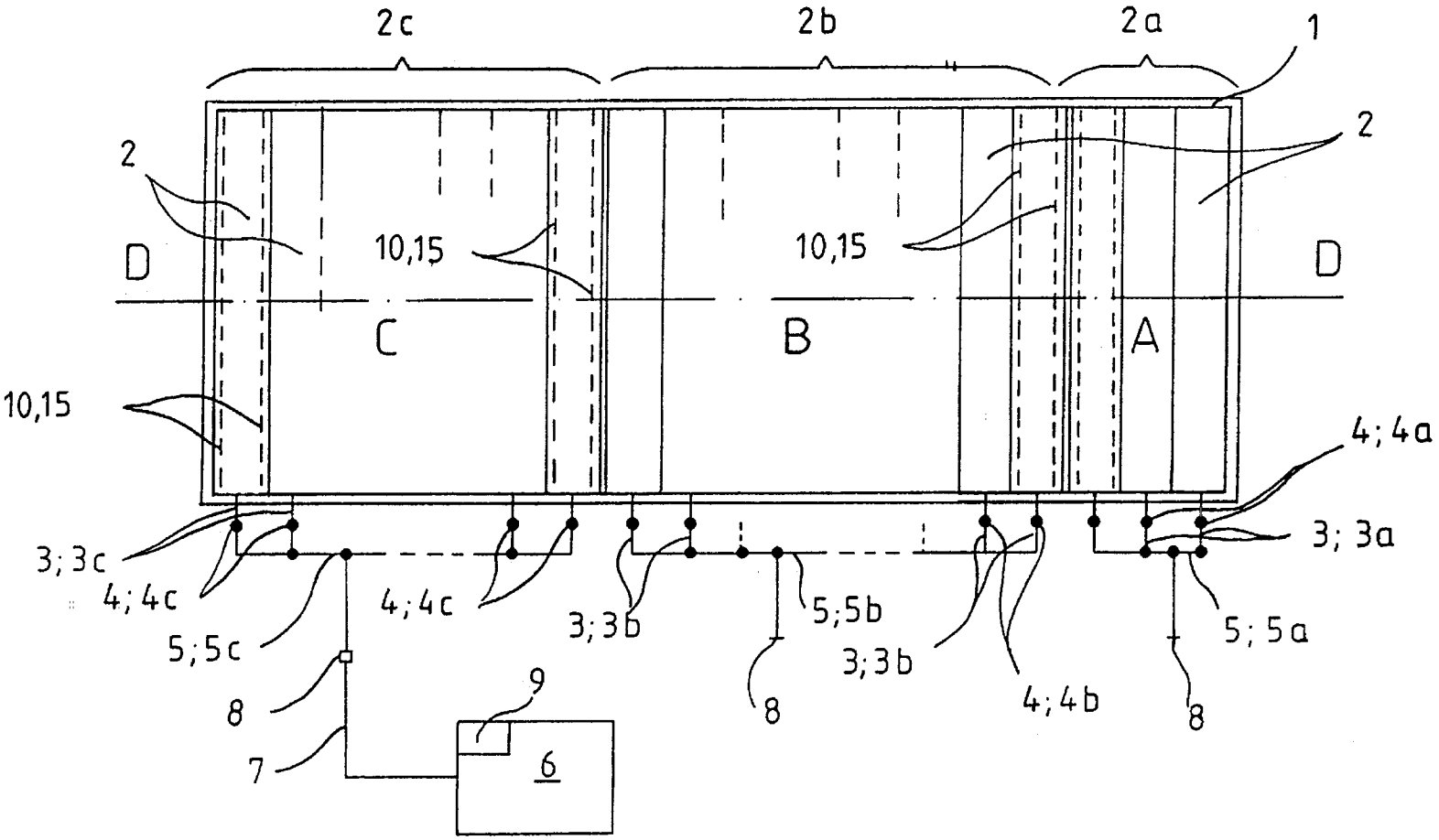
Figure 2A:
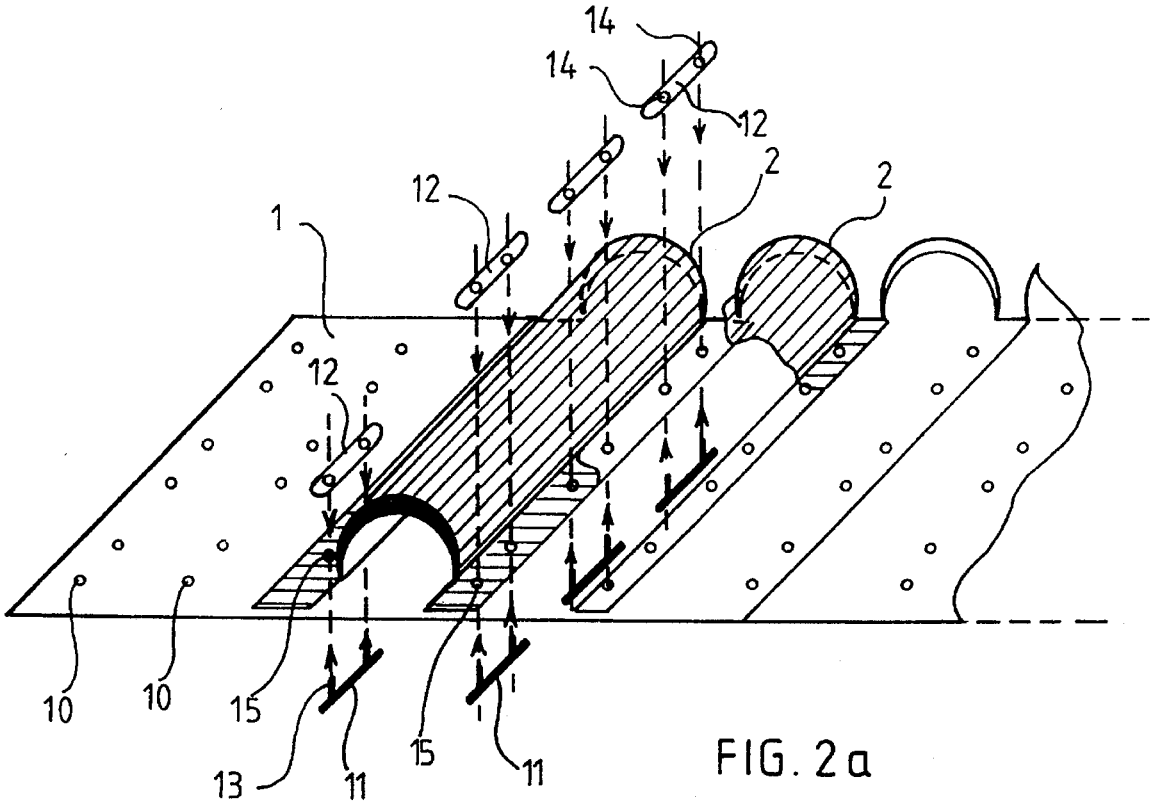

The mattress of FIGS. 1 and 2 comprises a bottom element 1 and a number of elongated, bag-like mattress elements 2. The bottom element 1 is a rectangular, plate-like and pliable piece. It is formed for instance of one or several plastic material layers. The mattress elements 2 may be inflated with gas, advantageously air, to a suitable pressure. They are attached side by side to the bottom element 1 of the mattress, and transversally to the longitudinal direction D—D of the mattress. The mattress elements 2 form protruding members, in cross-section resembling the shape of an overturned U or the like, which extend outwards from the bottom element 1, as is illustrated in FIG. 2*a*. The mattress elements are manufactured for example by welding together two rectangular elongated pieces of material so that the joint at the long side of the mattress element is wide enough to allow securing of the mattress element at this side to the bottom element. The joint is preferably several centimetres wide.

In the embodiment of FIG. 1, the mattress elements 2 of the mattress are divided, in the direction of the longitudinal axis D—D of the mattress, into three groups A, B and C. The first group A is meant to be under the head of the person lying on the mattress, the second group B under the middle part of the body, and the third group C under the legs. The mattress elements 2*a*, 2*b*, 2*c* of each group A, B, C communicate, via channels 3; 3*a*, 3*b*, 3*c* and valves 4; 4*a*, 4*b*, 4*c* fitted therein, with the connecting duct 5; 5*a*, 5*b*, 5*c* of each group. The mattress element groups 2*a*, 2*b*, 2*c* are connectable, via the connecting duct 5; 5*a*, 5*b*, 5*c* further to an air pump 6 or to a suitable gas source by means of a connecting channel 7 and suitable connecting pieces 8. In connection with the air pump 6, there is arranged a discharge valve and a pressure gauge 9. By means of the air pump 6 and by utilizing the discharge valve the mattress element groups 2*a*, 2*b*, 2*c* can be inflated in turns, first to a basic pressure and then to the final desired pressure when the patient is lying on the mattress. The pressure of the mattress elements 2; 2*a*, 2*b*, 2*c* of the invention is most suitably adjusted within the range of 15–25 cm $H_2O$ while the mattress is in use.

Figure 2B:
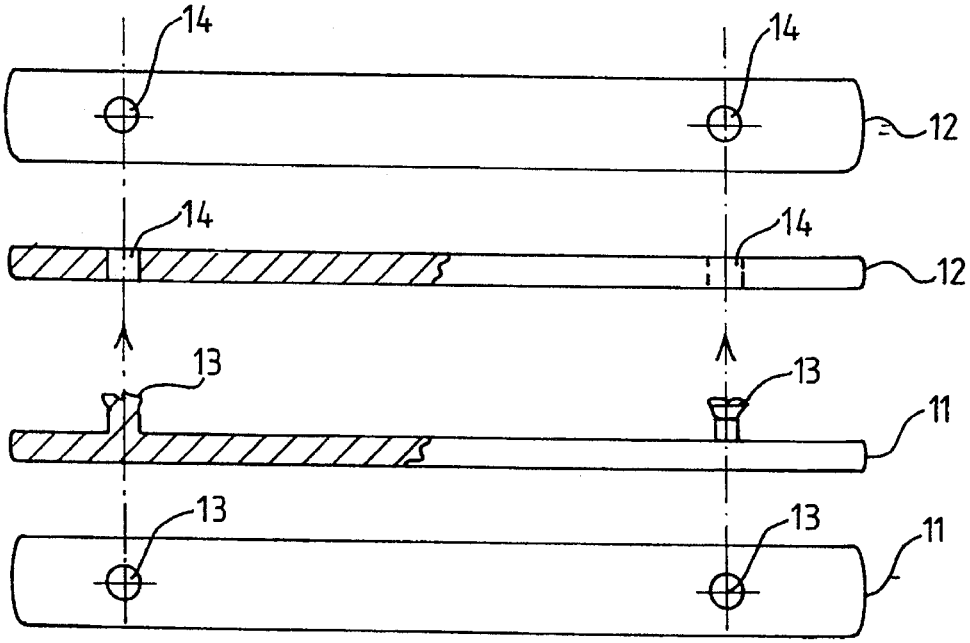

The mattress elements 2 of the mattress are attached to the bottom element 1 by means of fastening members. The bottom element 1 of the mattress has been provided with rows 10 of openings spaced apart from each other. There are corresponding openings also in the long sides of the mattress element 2. The fastening members are formed of matching male and female members 11 and 12 as may be seen from FIG. 2*b* illustrating an embodiment of fastening members as seen from the top and the side. The male fastening member 11 is formed of an elongated thin piece provided with two pins 13. The female fastening member 12 is formed of an elongated counterpart provided with openings 14. The male part is placed under the bottom element 1 of the mattress at the fastening openings 10 and 15 and the pins 13 are pushed through the openings 10 and 15. Preferably the long sides of the adjacent mattress elements 2 are placed overlapping in such a way that the pins are pushed through the openings 15 of both the mattress elements. The female fastening member 12 is placed on top of the edge of the topmost mattress element and the pins 13 are secured to the openings 14. In the embodiment of FIG. 2*a* there are three pairs of fastening members per one long side of the mattress, thus one mattress element is secured to the bottom element with six pairs of fastening members.

When a mattress element must be replaced the fastening members illustrated in FIG. 2*b* may be detached from the each other by means of a suitable tool by pushing the tool under the female fastening member and thus detaching the female fastening member 12 from the male fastening member 11. The tool may be for example a screwdriver or the like.

Figure 3A:
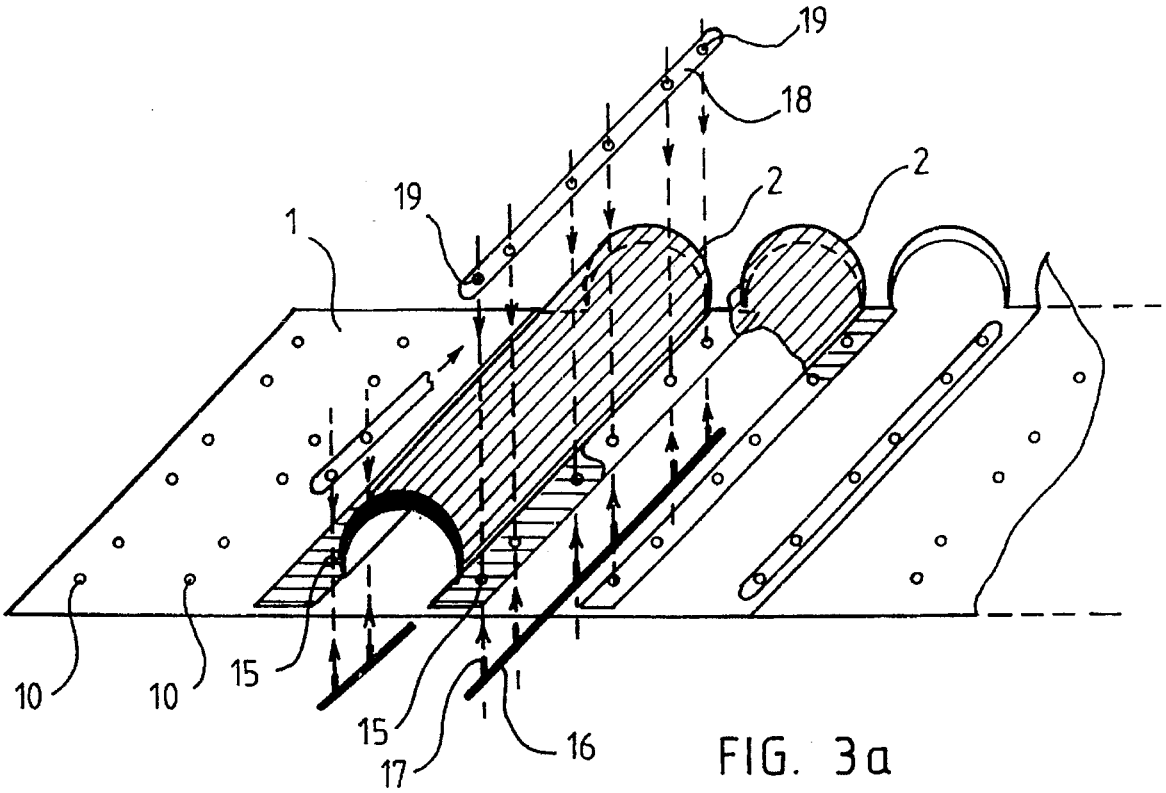
FIGS. 3*a* and 4*a* illustrate corresponding fastening members.
Figure 3B:
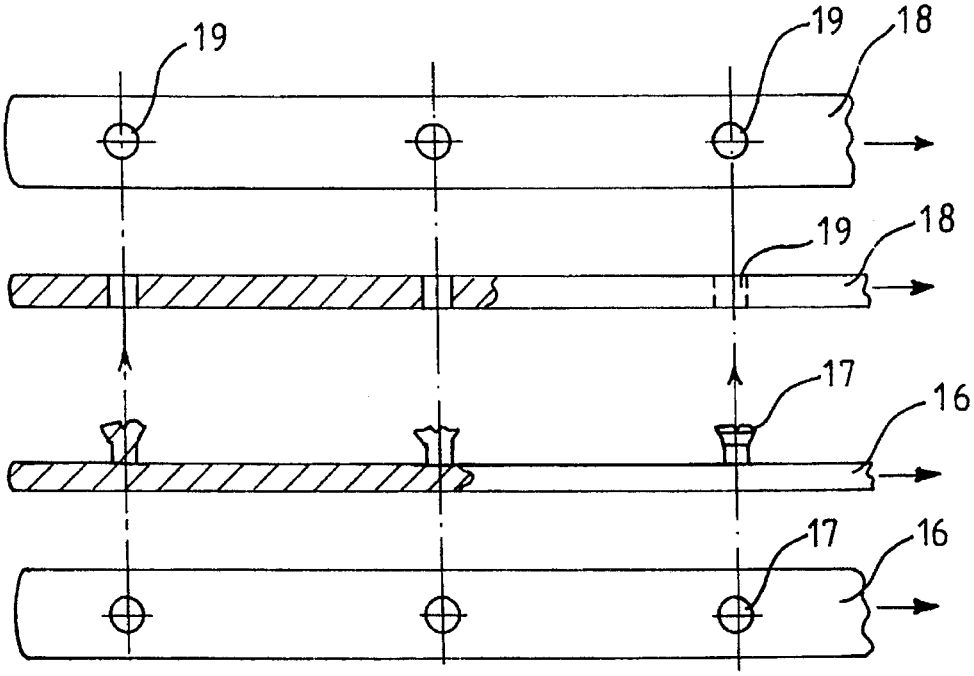
FIG. 3 and 4 illustrate other embodiments of a part of the mattress of FIG. 1, seen from the side.

FIGS. 3*a* and 3*b* illustrate an embodiment resembling the one illustrated in FIGS. 2*a* and 2*b*, only the fastening member here is essentially as long as the mattress element 2 and thus only one pair of fastening members is required per one side of the mattress element 2 for securing the mattress element to the bottom element. The male fastening member 16 provided with several pins 17 is secured to the female fastening member 18 placed on top of the edge of the mattress element 2 whereby the pins 17 disposed in the openings 10 of the bottom element and the openings of the mattress element are locked into the openings 19 of the female fastening member.

Figure 4A:
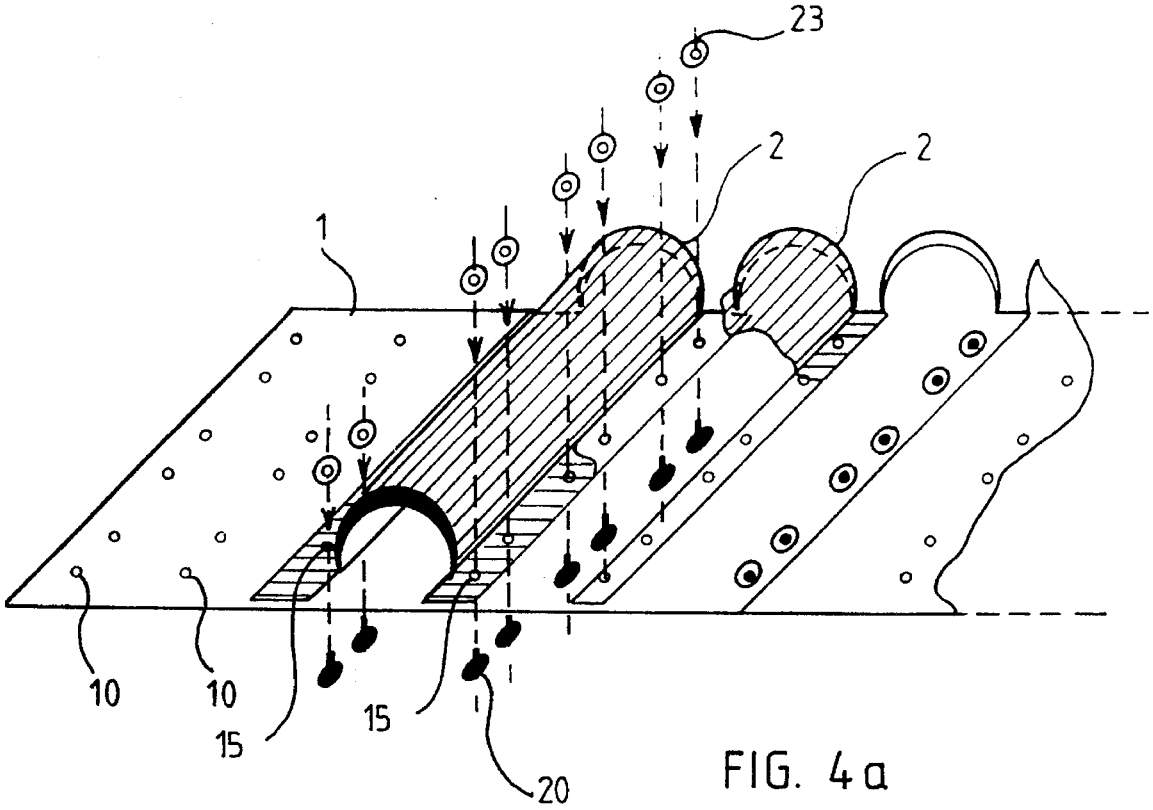
Figure 4B:
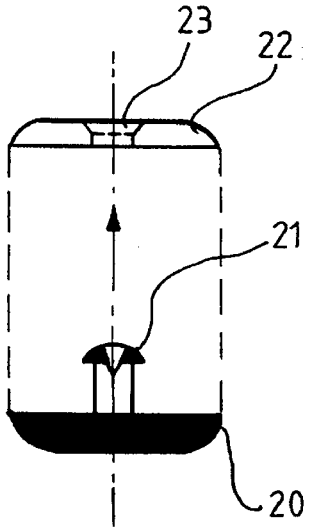

FIGS. 4*a* and 4*b* illustrate yet another embodiment of a fastening member, i.e. a press button. This fastening member comprises a male part 20 having a pin 21 and a female part 22 having an opening 23 matching the pin of the male part. As in the embodiments of FIGS. 2*a* and 2*b*, also in this embodiment the male part is disposed under the bottom element 1 of the mattress. The pin is placed in the openings 10 and 15 and it is locked into the openings 23 of the female part.

Figure 5:
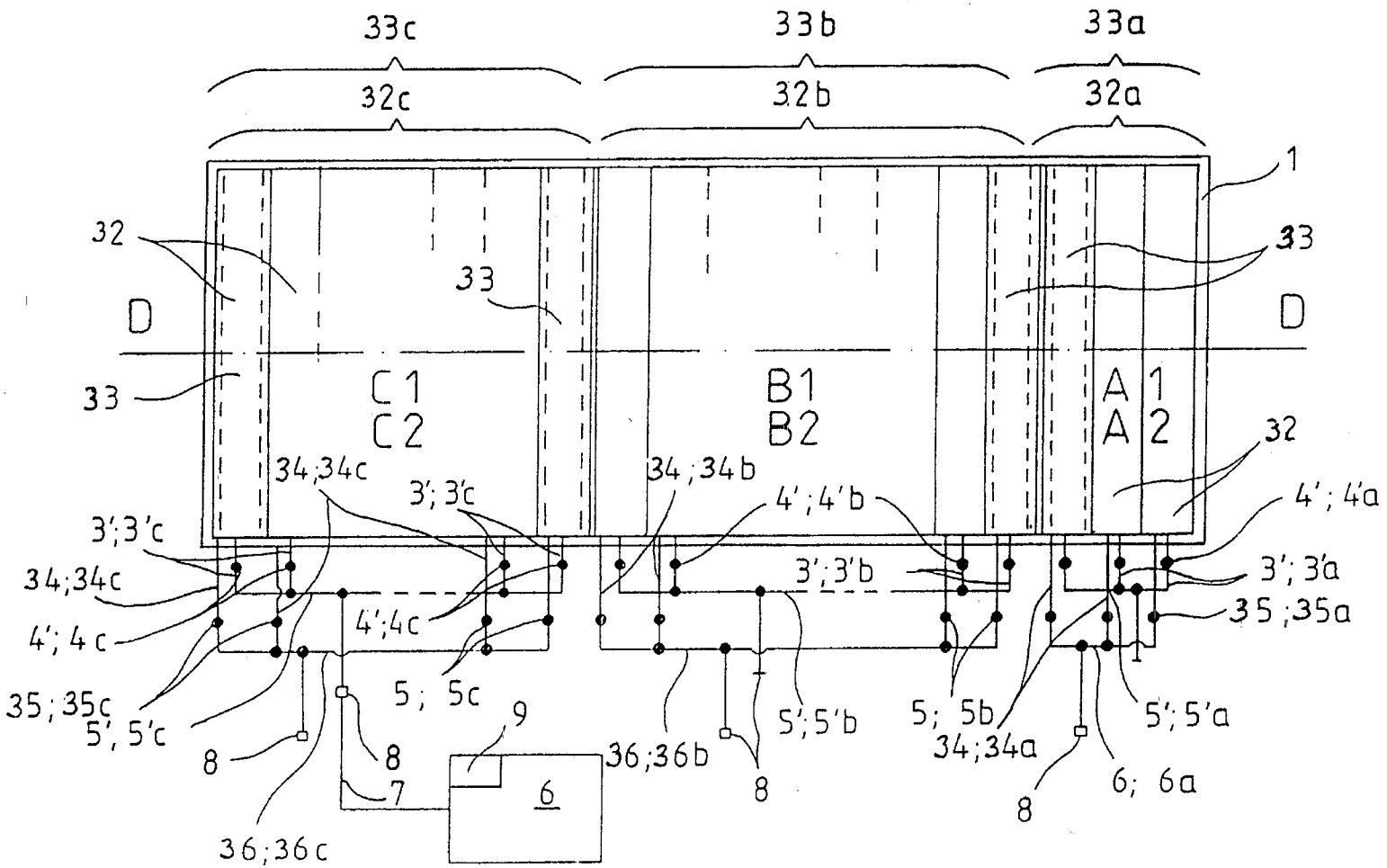
FIG. 5 is a schematic top-view illustration of another mattress of the invention.
Figure 6:
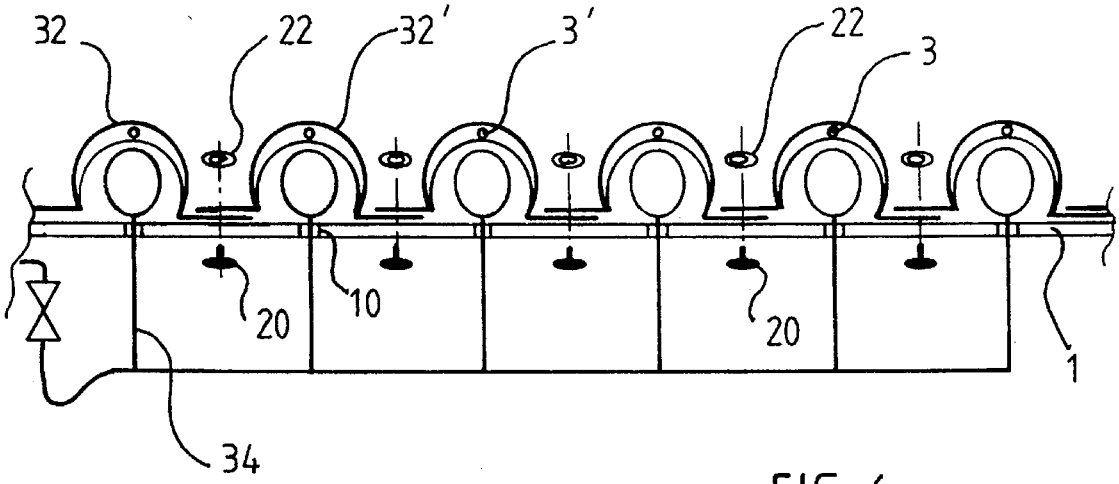
FIG. 6 illustrates mattress elements of the mattress of FIG. 5, seen from the side.

Another mattress of the invention, particularly an air mattress, is illustrated in FIGS. 5 and 6. This mattress comprises a bottom element 1, a number of first bag-like mattress elements 32 and a number of second bag-like mattress elements 33. The bottom element 1 and the first mattress elements 32 correspond to the bottom element 1 and mattress elements 2 of the mattress illustrated in FIGS. 1 and 2*a*, 3*a* and 4*a*, respectively. In this case the bottom elements 1 are similar, and the same reference number is used of both. The second elongated bag-like mattress elements 33 are inflatable with gas, such as air, or alternatively they are elements made of some solid, resilient material or inflated with such material. In this embodiment, the second mattress element 33 is formed of an air-inflatable member. Encompassing each second mattress element 33, at least partly, there is provided the first mattress element 32, as can be understood for instance from FIG. 6. The second mattress elements are preferably separate elements encompassing the first mattress elements but they may be provided stationary for example by welding them to the bottom element 1 of the mattress. However, this alternative is not as advantageous as separate elements, in view of the maintenance and cleaning of the mattress.

Seen from above, the mattress formed of the mattress elements 32, 33 in FIG. 5 looks the same as the mattress formed of mattress elements 2 in FIG. 1. The first and the second mattress elements 32, 33 may be divided into three groups in the same way as the mattress elements 2 mentioned above.

The first mattress elements 32 are thus divided into three groups A1, B1, C1 comprising mattress elements 32*a*, 32*b*, 32*c*, respectively. The elements 32; 32*a*, 32*b*, 32*c* belonging to each group A1, B1, C1 communicate via channels 3'; 3'*a*, 3'*b*, 3'*c* and via valves 4'; 4'*a*, 4'*b*, 4'*c* fitted therein, with the connecting duct 5'; 5'*a*, 5'*b*, 5'*c* of each group. The mattress element groups 32*a*, 32*b*, 32*c* are connectable, through the connecting ducts 5'; 5'*a*, 5'*b*, 5'*c*, further to an air pump 6 or a corresponding gas source via a connecting channel 7 and suitable connecting pieces 8, as was described above in connection with FIG. 1.

The second set of mattress elements 33 is divided into three groups A2, B2, C2, comprising mattress elements 33*a*, 33*b*, 33*c*, respectively. The mattress elements 33; 33*a*, 33*b*, 33*c* communicate via channels 34; 34*a*, 34*b*, 34*c* and valves 35; 35*a*, 35*b*, 35*c* fitted therein with a connecting duct 36; 36*a*, 36*b*, 36*c*, which is further connectable to an air pump 6 via a connecting channel 7 and suitable connecting pieces 8. By using the air pump 6, the second mattress elements 33; 33*a*, 33*b*, 33*c* of each group A2, B2, C2 may be inflated to a suitable basic pressure while the mattress is in use. The actual adjustment of the mattress may be effected by adjusting the pressures of the first mattress elements 32; 32*a*, 32*b*, 32*c*.

It is also possible not to divide the first mattress elements 32 into the groups A1, B1, C1 mentioned above, in which case they are composed of single mattress elements 32, or alternatively of small groups of two or three elements, so that the gas pressure of each mattress element can be measured and adjusted separately or in small groups, for instance by means of the air pump 6, the discharge valve and the pressure gauge 9, as was described above. This adjusting method is advantageous, because certain parts of the body (for example bony, protrusive points such as the heel, sacrum, shoulder blades and the back of the head) are particularly susceptible to the creation of bedsores. It is also possible that the patient already has bedsores, as a result of previous unfavourable circumstances, in other parts of the body, too. The surface pressure directed to the critical points can now be minimized by lowering the gas pressure in the mattress element 32 located at the critical spot, for instance at the heel, and respectively, the gas pressure in the adjacent mattress elements is raised.

The first mattress elements 32 are secured to the bottom element 1 of the mattress in the same way as the securing of mattress elements 2 illustrated in FIG. 2*a* and 4*a*. In the embodiment of FIG. 6 the mattress by elements 32 have been secured to the bottom element 1 of the mattress by press buttons illustrated in FIG. 4*b*. The figure shows how the mattress elements 32 have been placed overlapping, i.e. the long sides of the mattress elements 32 and 32' are placed one on top of the other on the bottom element and both the mattress elements are secured at the same time to the bottom element by pushing the pin of the male fastening member 20 through the openings in the bottom element and the mattress elements and by securing the pin to the counterpart 22 of the press button. When for one reason or another, one of the first mattress elements 32 is at least partly deflated and the pressure therein decreases, it can quickly be replaced while still using the mattress, because the mattress elements are easily detachable from each other and the replacing does not necessarily cause problems to the patient lying on it. The defective mattress element 32 is located in the mattress element group A1, B1, C1, in case the mattress is divided into such groups, and the valves 4' of other mattress elements 32*a*, 32*b*, 32*c* are closed (in case they are open). The fastening member 20 and 22 are detached from each other, after which the first mattress element 32 is removed from around the second mattress element 33. After that a new, undamaged first mattress element 32 may be installed, by similarly attaching the fastening members 20 and 22 to each other. The first mattress element 32 is connected, via the channel 3' and the valve 4' to the connecting duct 5' of said mattress element group A1, B1, C1. The air pump 6 is connected, by means of the connecting channel 7 and connecting pieces 8 to the connecting duct 5'. The mattress element 32 is inflated by the air pump 6 up to a suitable pressure, after which the valve 4' can be closed and the air pump 6 detached by the connecting pieces 8 from the corresponding mattress element group 32; 32*a*, 32*b*, 32*c*. Now the mattress is again in condition for use.

Figure 7:
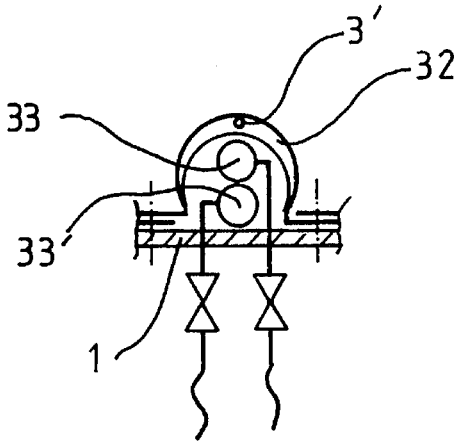
FIG. 7 illustrates a mattress element of a third mattress of the invention, seen from the side.
Figure 8:
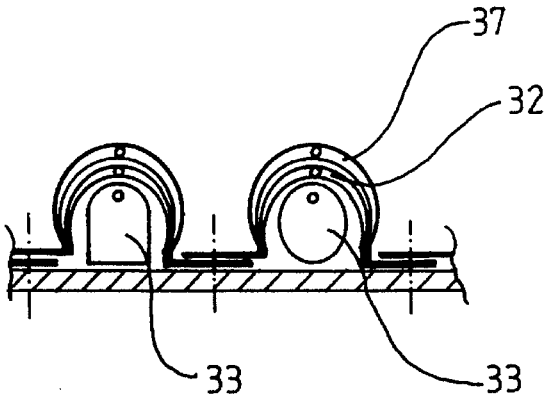
FIG. 8 illustrates a mattress element of a fourth mattress of the invention, seen from the side.

FIG. 7 illustrates how at least two first loop-like mattress elements 32 may be placed surrounding several other mattress elements 33, 33'. The purpose of providing several elements one on the other is to intensify the effect of the mattress. Further, the first loop-like mattress elements 32, 37 may be provided at least one inside the other (see FIG. 8).

In the above specification, the invention has been described with reference to several embodiments thereof, but it is naturally clear that the invention can be modified in many ways within the scope of the appended patent claims. It is also pointed out that the pressures in the mattress elements can be adjusted in many ways, as was described for instance in the parent application Ser. No. 07/209,978, U.S. Pat. No. 4,999,867. Moreover, the mattress elements can be divided into more groups than in the above specification, and those mattress elements that are located in the marginal areas thereof can be divided into alternating groups, as was also described in the patent application mentioned.

We claim:

1. An inflatable mattress, comprising:

a bottom element substantially rectangular in shape and forming a plate-shaped and bendable piece;

a plurality of first elongated, bag-shaped mattress elements capable of being inflated with a fluid, and being secured side by side to the bottom element of the mattress and transversally to a lengthwise direction of the mattress so that the first mattress elements form loop-shaped members when inflated with a fluid, the loop-shaped members resembling an overturned U-shape in cross-section and extending outwards from the bottom element, the first mattress elements being secured to the bottom element of the mattress by interlockable fastening members, receivable in flaps provided on longitudinal sides of the first mattress elements, so that each first mattress element is capable of being detached from the bottom element and replaced;

a plurality of second elongated, bag-shaped mattress elements capable of being inflated with gas or other fluid medium or being made of a solid, resilient material or being inflated with the solid, resilient material; the first mattress elements being arranged to encompass, at least partly, each second mattress element; and wherein the fastening members are formed of matching male and female members, the longitudinal sides of each first mattress element and the bottom element of the mattress are provided with securing openings at a distance from each other at which the fastening members are locked to each other when the longitudinal side of each first mattress element and the bottom element have been placed between the fastening members, and the flaps on the longitudinal sides of adjacent first mattress elements are overlappable so that the adjacent first mattress elements are fastenable by a single fastening element.

2. A mattress as claimed in claim 1, wherein the male fastening member is formed of an elongated thin piece provided with at least one bracket, and the female fastening member is formed of an elongated couterpart provided with openings, the at least one bracket being locked to these openings.

3. A mattress as claimed in claim 2, wherein the male and the female fastening members are essentially shorter than the first mattress elements, whereby at least two of the fastening members are provided to secure one first mattress element to the bottom element of the mattress.

4. A mattress as claimed in claim 2, wherein the male and the female fastening members are substantially as long as the first mattress element, whereby one male and one female fastening member secures the first mattress element to the bottom of the mattress.

5. A mattress as claimed in claim 1, wherein the fastening members are formed of opposite parts of a press button.

6. An inflatable mattress, particularly an air mattress, comprising:

a bottom element substantially rectangular in shape, and forming a plate-shaped and bendable piece;

a number of first elongated, bag-shaped mattress elements, capable of being inflated with a fluid and being secured side by side to the bottom element of the mattress transversally to a lengthwise direction of the mattress, and forming, when inflated with a fluid, loop-shaped members resembling an overturned U-shape in cross-section, and extending outwards from the bottom element, the first mattress elements provided with outwardly extending flaps on longitudinal sides, the flaps being detachably secured to the bottom element of the mattress by interlockable fastening members so that each first mattress element may be detached from the bottom element and replaced, flaps of adjacent first elements being overlappable a number of second elongated, bag-shaped mattress elements capable of being inflated with gas or other fluid medium, or being made of a solid, resilient material, or being inflated with the solid, resilient material; the first mattress elements being arranged to encompass, at least partly, each second mattress element; and wherein the fastening members are formed of matching male and female members, and the male fastening member is formed of an elongated thin piece provided with at least one bracket, and the female fastening member is formed of an elongated counterpart provided with openings, the at least one bracket being locked to these openings.

7. A mattress as claimed in claim 6, wherein the male and the female fastening members are essentially shorter than the first mattress elements, whereby at least two of the fastening members are provided to secure one first mattress element to the bottom element of the mattress.

8. A mattress as claimed in claim 7, wherein the male and the female fastening members are substantially as long as the first mattress element, whereby one male and one female fastening member secures the first mattress element to the bottom element of the mattress.

9. A mattress as claimed in claim 6, wherein at least one of the fastening members is an integrated part of the bottom element of the mattress.

10. An inflatable mattress, comprising:

a bottom element being substantially rectangular in shape, and forming a plate-shaped and bendable piece; and a number of elongated, bag-shaped mattress elements, capable of being inflated with a fluid, and being secured to the bottom element of the mattress side by side and transversally to a lengthwise direction of the mattress to form, when inflated with a fluid, loop-shaped members, resembling an overturned U-shape in cross-section, and extending outwards from the bottom element, the mattress elements being secured to the bottom element of the mattress by interlockable male and female fastening members so that each mattress element may be detached from the bottom element and replaced, whereby flaps, provided on longitudinal sides of each mattress element, and the bottom element have been provided with securing openings spaced-apart at which the fastening members are locked to each other after the flaps and the bottom element of the mattress have been placed between the fastening members, and whereby the male fastening member is formed of an elongated thin piece provided with at least one bracket, and the female fastening member is formed of an elongated counterpart provided with openings into which openings the bracket is locked.

11. The mattress as claimed in claim 10, wherein there are at least two mattress elements provided one inside the other.

12. An inflatable mattress, comprising:

a bottom element substantially rectangular in shape, and forming a plate-shaped, bendable piece;

a number of first elongated, bag-shaped mattress elements capable of being inflated with a fluid, and being secured to the bottom element of the mattress side by side and transversally to a lengthwise direction of the mattress to form, when inflated with a fluid, loop-shaped members resembling an overturned U-shape in cross-section, and extending outwards from the bottom element, outwardly extending flaps along longitudinal sides of the first mattress elements being fastened to the bottom element of the mattress by interlockable male and female fastening members so that each first mattress element may be detached from the bottom element and replaced, whereby the flaps of each first mattress element and the bottom element have been provided with securing openings spaced-apart at which the separate fastening members are locked to each other after the flaps of the first mattress element and the bottom element of the mattress have been placed between the fastening members, and whereby the male fastening member is formed on an elongated thin piece provided with one or several brackets, and the female fastening member is formed of an elongated counterpart provided with openings into which openings the brackets are locked; and a number of second elongated, bag-shaped mattress elements capable of being inflated with gas or other fluid medium, or being made of a solid, resilient material, or being inflated with the solid, resilient material; the first mattress element being arranged to encompass, at least partly, each second mattress element.

13. The mattress as claimed in claim 12, wherein the first mattress element encompasses at least two second mattress elements.

* * * * *